US012529534B1

(12) United States Patent
Matejcik

(10) Patent No.: US 12,529,534 B1
(45) Date of Patent: Jan. 20, 2026

(54) AMBIDEXTROUS SLIDE RELEASE

(71) Applicant: Christopher Matejcik, Wildomar, CA (US)

(72) Inventor: Christopher Matejcik, Wildomar, CA (US)

( * ) Notice: Subject to any disclaimer, the term of this patent is extended or adjusted under 35 U.S.C. 154(b) by 0 days.

(21) Appl. No.: 19/051,158

(22) Filed: Feb. 11, 2025

(51) Int. Cl.
*F41A 3/72* (2006.01)
*F41A 35/06* (2006.01)

(52) U.S. Cl.
CPC ..... *F41A 3/72* (2013.01); *F41A 35/06* (2013.01)

(58) Field of Classification Search
CPC ..... F41A 35/06; F41A 3/72
See application file for complete search history.

(56) References Cited

U.S. PATENT DOCUMENTS 4,176,584 A * 12/1979 Thomas, Jr. ..... F41A 17/38 89/196
11,846,483 B1 * 12/2023 Smathers ..... F41A 3/66

* cited by examiner

*Primary Examiner* — Reginald S Tillman, Jr.
(74) *Attorney, Agent, or Firm* — Michael D. Eisenberg; MDE Patents

(57) ABSTRACT

In the embodiments herein, an ambidextrous slide is fitted on a firearm. The ambidextrous slide comprises: a slide release and catch mechanism configured for locking a slide of the firearm to a rear position, followed by sending the slide forward on the firearm using a thumb. The slide release and catch mechanism comprises: a left side slide release lever; a right side slide release lever; a spring and detent held in by a set screw; and a plunger detent with a dovetail flange with a first end and a second end.

15 Claims, 5 Drawing Sheets

AMBIDEXTROUS SLIDE RELEASE

FIELD OF INVENTION

The systems and methods herein are directed to firearm parts and accessories.

BACKGROUND OF THE INVENTION

The 2011/1911 firearm platform has always been right-handed user friendly and never developed with left-handed users in mind. To address this problem is an ambidextrous slide release for these platforms. The only way that people have addressed these issues for left-handed users is by trying to learn how to operate these platforms by other means with your hands. No real physical solution or change has been developed, only different handling techniques.

What is needed is the systems and methods herein directed to an ambidextrous slide release that can be operated by hand and appended, as an accessory, to a 2011/1911 firearm.

BRIEF SUMMARY OF THE EMBODIMENTS OF THE INVENTION

In a variant, an ambidextrous slide release is fitted on a firearm. The ambidextrous slide release comprises: a slide release and catch mechanism configured for locking a slide of the firearm to a rear position, followed by sending the slide forward on the firearm using a thumb. The slide release and catch mechanism comprises: a left side slide release lever; a right side slide release lever; a spring and detent held in by a set screw; and a plunger detent with a dovetail flange with a first end and a second end.

In a variant, the dovetail is configured to: connect to the right side slide release lever at the first end; and connect to the left side slide release lever at the second end.

In a variant, the plunger detent operatively connects to a hole for the plunger detent, thereby locking the right side slide release lever in place during use of the firearm.

In a variant the dovetail flange is a 45 degree flange.

In a variant, the internal spring, the detent, and the set screw act as an end of the slide release.

In a variant, the spring resides internally within a cylinder. The cylinder receives the set screw and the dove tail flange. The dove tail flange operatively connects to the right side slide release lever. The set screw operatively connects to the left side slide release lever.

In a variant, the right side slide release lever operatively connects to a single piece. The single piece is the cylinder and the left side slide release lever.

In a variant, the cylinder and the left side slide release lever make a perpendicular connection in the single piece.

In a variant, the cylinder and the right side slide release lever make a perpendicular connection with each other.

In a variant, the right side slide release lever is parallel to the left side slide release lever.

In a variant, the spring, cylinder, detent, and the right side slide release lever are composed of aluminum 6061, iron alloys, carbon steel, titanium, stainless steel, or other metallic parts.

In a variant, the dovetail flange comprises a sawtooth pattern.

In a variant, the left slide release lever further comprises a lug.

In a variant, the right slide release lever comprises a 20 degree channel configured for receiving a 20-degree appendage.

In a variant, the cylinder comprises a 20 degree appendage configured for fitting into a 20-degree channel.

In a variant, the firearm comprised a 1911 slide release, 2011 slide release, 1911 slide catch, and 2011 slide catch.

In a variant, a method for assembling an ambidextrous firearm comprises: removing factory slide release; inserting a left side slide release lever; sliding a right side slide release lever on with a dovetail flange, while pushing down a detent until a slide of the firearm to a rear position locks into place by a detent groove hole, thereby yielding a setup configured for: operating the firearm until ammunition runs out and the slide of the firearm automatically locks to the rear position, thereby allowing for the insertion of a new source of ammunition, such that a left-handed user can utilize left thumb to actuate the right side slide release lever down to send the slide forward to commence continued use of the firearm.

In a variant, the firearm comprises a 1911 slide release, 2011 slide release, 1911 slide catch, and 2011 slide catch.

In a variant, the dovetail flange is a 45 degree flange comprising a sawtooth pattern.

In a variant, the spring, cylinder, detent, and the right side slide release lever is composed of aluminum 6061, iron alloys, carbon steel, titanium, stainless steel, or other metallic parts.

BRIEF DESCRIPTION OF THE FIGURES

The systems and methods herein are directed to an ambidextrous slide release that can be operated by hand and appended, as an accessory, to a 2011/1911 firearm, in accordance with one or more various embodiments, which are described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

FIG. 7, FIG. 8, and FIG. 9 are depictions of the firearm, to which ambidextrous slide release is appended to.

Figure 1:
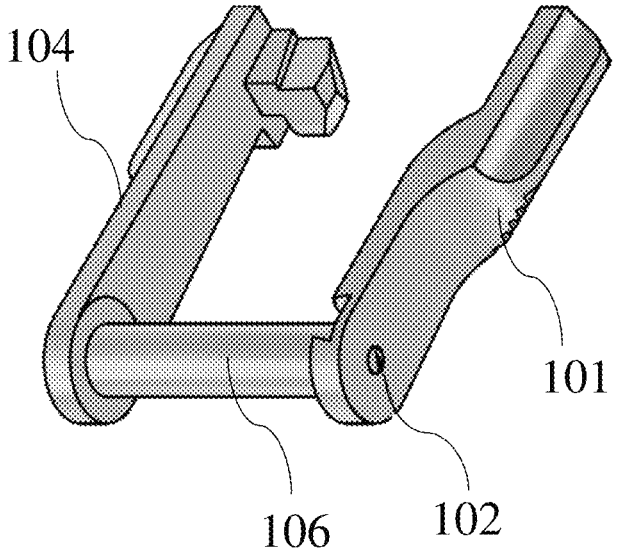
FIG. 1 and FIG. 2 are depictions of an ambidextrous slide release.

The figures are not intended to be exhaustive or to limit the invention to the precise form disclosed. It should be understood that the invention can be practiced with modification and alteration and that the invention be limited only by the claims and the equivalents thereof.

Some of the figures included herein illustrate various embodiments of the invention from different viewing angles. Although the accompanying descriptive text may refer to such views as "top", "bottom" or "side" views, such references are merely descriptive and do not imply or require that the invention be implemented or used in a particular spatial orientation unless explicitly stated otherwise.

DETAILED DESCRIPTION OF THE EMBODIMENTS OF THE INVENTION

The systems and methods herein are directed to an ambidextrous slide release that can be operated by hand and appended, as an accessory, to a 2011/1911 firearm. The ambidextrous slide release does not in any way alter or affect the firing or rate at which the firearm is discharged, while aiding left-handed users to be able to manipulate the firearm as right-handed users do currently. The variations of ambidextrous slide releases that are going to be worked through are developing this product for the 2011/1911 (milspec) platforms with two versions, standard and extended for a total of four variants.

The ambidextrous slide release, of the systems and methods herein, is described herein in terms of example embodiments. After reading this description, it will become apparent to one of ordinary skill in the art how the invention can be implemented in different and alternative embodiments.

From time-to-time, the ambidextrous slide release, of the systems and methods herein, is described herein in terms of example environments. Description in terms of these environments is provided to allow the various features and embodiments of the ambidextrous slide release, of the systems and methods herein, to be portrayed in the context of an exemplary application. After reading this description, it will become apparent to one of ordinary skill in the art how the ambidextrous slide release, of the systems and methods herein, can be implemented in different and alternative environments.

In the systems and methods herein, the ambidextrous factor of the ambidextrous slide release described herein can be a platform for 2011/1911 gun users that are left-handed, without being burdensome or cumbersome to gun users that are right-handed. The ambidextrous slide release can allow for the functional manipulation and handling of 2011/1911 firearms for current and future users, which has not been done before, especially for 2011/1911 firearms that have been on the market for over 113 years.

In the systems and methods herein, the ambidextrous slide release is an accessory that can be appended to a firearm. The ambidextrous slide release can have a slide release and catch mechanism configured for locking a slide of the firearm to a rear position, followed by sending the slide forward on the firearm using a thumb. The slide and catch mechanism can comprise: (i) a left side slide release lever; (ii) an ambidextrous right side slide release lever; (iii) an internal spring and detent held in by a set screw to act as the end of the slide release; (iv) a plunger detent with a 45 degree dovetail flange with a first end and second end, such that the dovetail is configured to: accept the ambidextrous right side lever on the right side of the firearm; and (iv) a hole for the plunger detent to lock the ambidextrous right side lever in place during use of the firearm.

In the systems and methods herein, a firearm can be assembled or appended with the ambidextrous slide release by: (1) removing factory slide release; (2) inserting left side slide release lever of the ambidextrous slide release; (3) sliding an right side ambidextrous lever on with a dovetail flange in the cylinder of the ambidextrous slide release, while pushing down detent, until a slide of the fire arm passes over and locks into place by the detent groove hole; (4) operating the firearm until ammunition runs out and the slide automatically locks to the rear; and (5) inserting a new source of ammunition, as a left-ambidextrous handed user now uses his or her left thumb to: (i) actuate the right side lever down and (ii) send the slide forward to commence continued use of the firearm.

Figure 2:
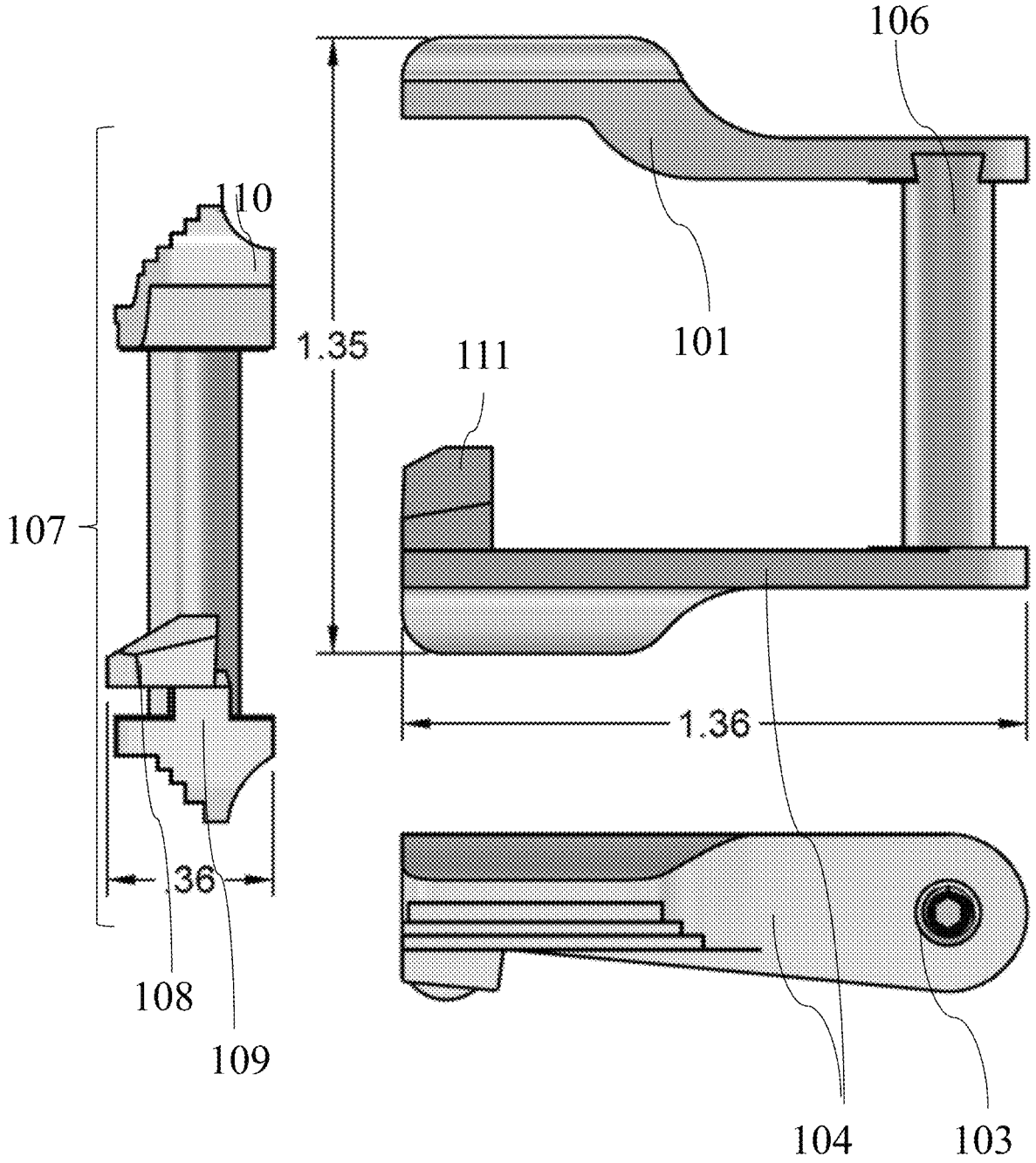
Figure 6:
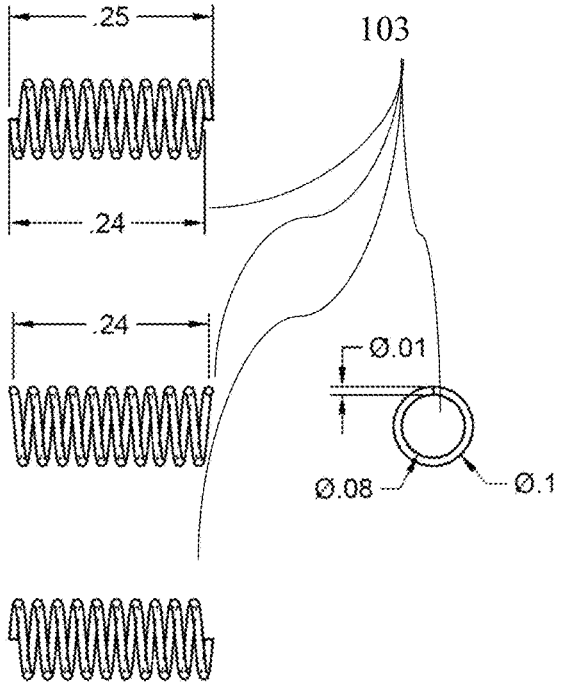
FIG. 6 is a depiction of a spring in the cylinder of the ambidextrous slide release.

In the systems and methods herein, the ambidextrous slide release is an assembly wherein: right side slide release lever 101 is operatively connected to a single component, wherein the single component is left side slide release lever 104 operatively connected to cylinder 106. Springs, such as spring 103, reside in cylinder 106, wherein cylinder 106 makes a perpendicular connection with left slide release lever 104 and right slide release lever 101. Spring 103 and detent 102 are held in by set screw 103. Dovetail flange 107, which can comprise top and bottom sawtooth patterns 110, 109 and appendage 108 has a gap proximal to sawtooth pattern 109 and behind lug 111. Left side slide release lever 104 comprises lug 111 on the surface of left side slide release lever 104, wherein lug 110 is an appendage appended to the surface of left side slide lever 104. (See FIG. 1, FIG. 2, and FIG. 6.)

Figure 3:
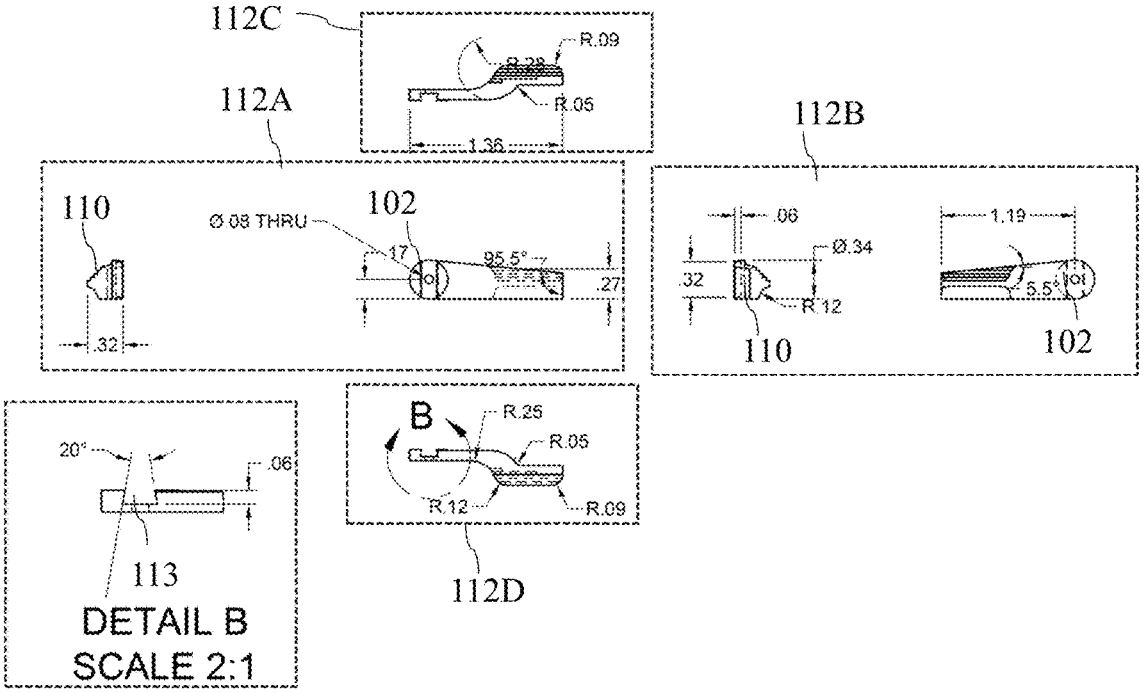
FIG. 3 is a depiction of a right side of the ambidextrous slide release.
Figure 5:
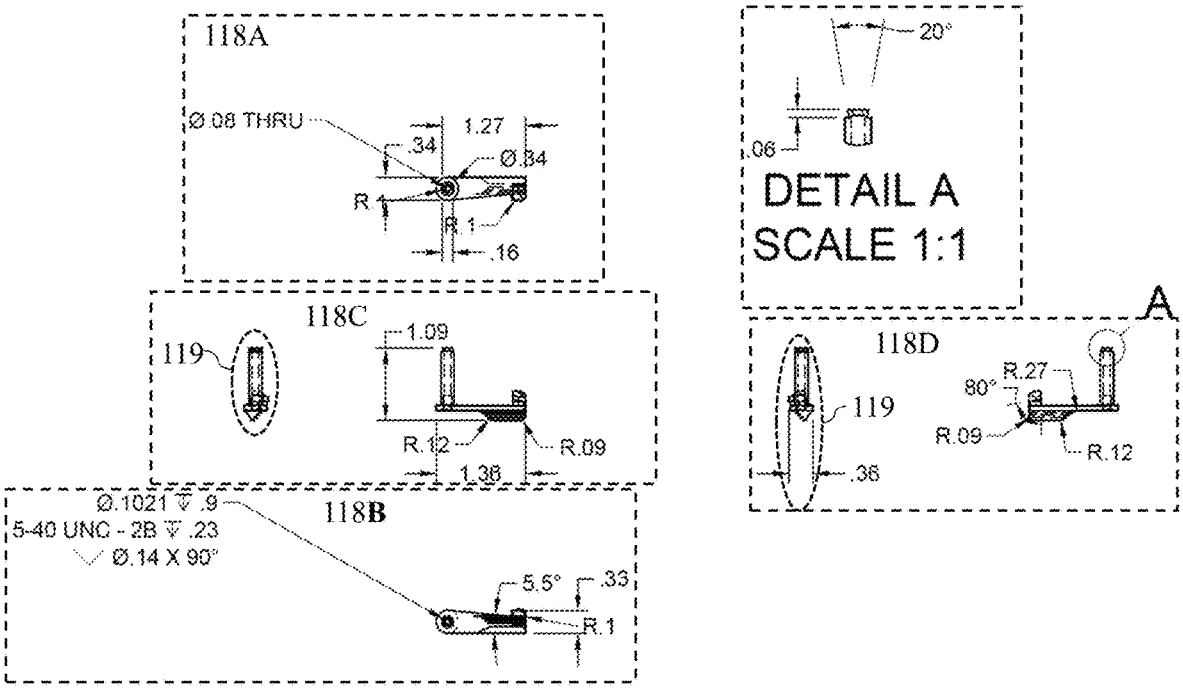
FIG. 5 is a depiction of a left side of the ambidextrous slide release.

In the systems and methods herein, right side slide release lever 101 has channel 113, which is 20 degrees (see Detail B in FIG. 3), for receiving an extending component that is also 20 degrees (see Detail A in FIG. 5), to make a secure fit with the extending component. Subassembly 112 is depiction of top sawtooth pattern 110 of dovetail flange 107 configured for a thumb indexing the lever (rear of the right side lever), wherein subassembly 112 operatively is connecting to detent 102 of right side slide release lever 101, where the suffixes of A, B, C, and D to 112, denote different views of subassembly 112. Subassembly 112C is subassembly 112D that has been rotated 180 degrees, and vice versa. Subassembly 112A is subassembly 112B that has been rotated 180 degrees, and vice versa. Detent 102 is a plunger that can receive dovetail flange 107. (See FIG. 3.)

Figure 4:
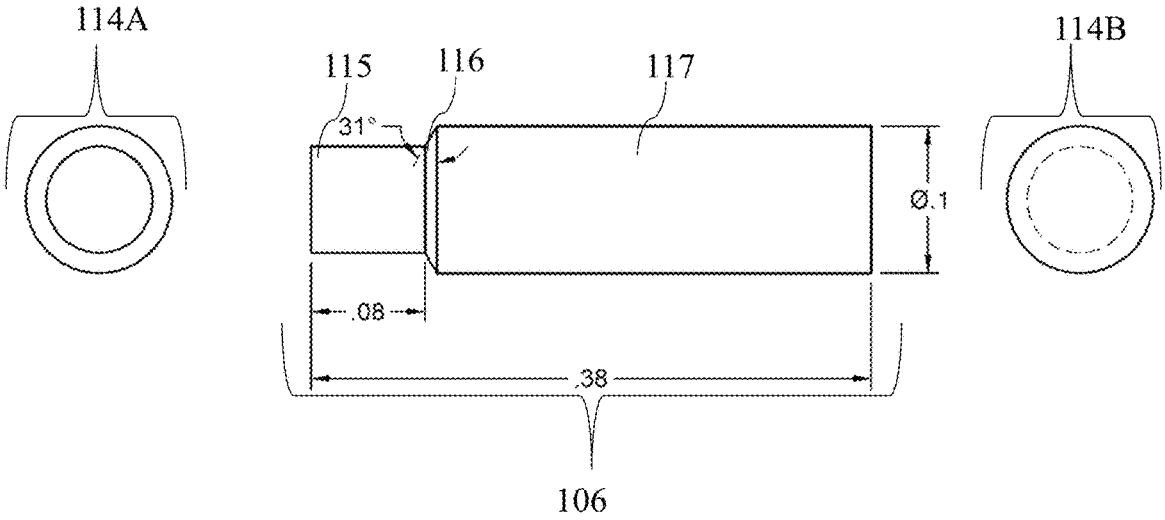
FIG. 4 is a depiction of a cylinder of the ambidextrous slide release.

In the systems and methods herein, cylinder 106 comprises section 116, wherein section 116 is operatively connected to section 117 and section 115. Section 116 can be oriented in between sections 115 and 117, such that there is a 31 degree angle corresponding to a reduced diameter of cylinder 106, where detent 102 is T-shaped, such that a top section has the same diameter as the larger diameter hole and catches the smaller diameter to prevent detent 102 from falling out the other side. Diameter circle 114 is a depiction of the larger and smaller diameter holes on/of cylinder 106, where suffixes A and B to 112, denote different views of cross-section 114. Cross-section 114A is cross-section 114B that has been rotated 180 degrees, and vice versa. (See FIG. 4.)

In the systems and methods herein, left side slide release lever 104 has flange 119, which an extending component that is 20 degrees (see Detail A in FIG. 5), can be received by channel 113, which is 20 degrees (see Detail B in FIG. 3) to make a secure fit with the extending component. Subassembly 118 is a depiction of flange 119, that operatively connects to the set screw of left side slide release lever 104, where the suffixes of A, B, C, and D to 118, denote different views of subassembly 118. Flange 119 depicts the left side assembly (i.e., a sawtooth pattern on the bottom and a quadrilateral extending piece that can be trapezoidal); whereas flange 107 depicts both the right and left side lever connected. Subassembly 118C is subassembly 118D that has been rotated 180 degrees, and vice versa. Subassembly 118A is subassembly 118B that has been rotated 180 degrees, and vice versa. (See FIG. 5.)

Figure 7:
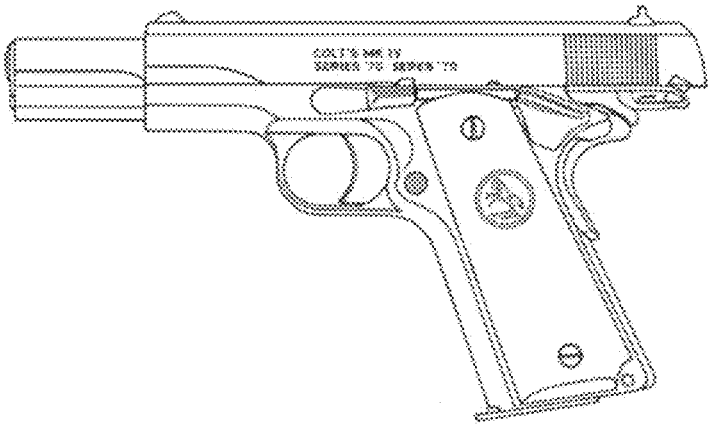
Figure 8:
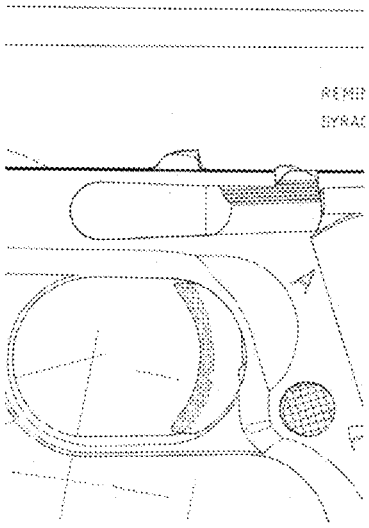
Figure 9:
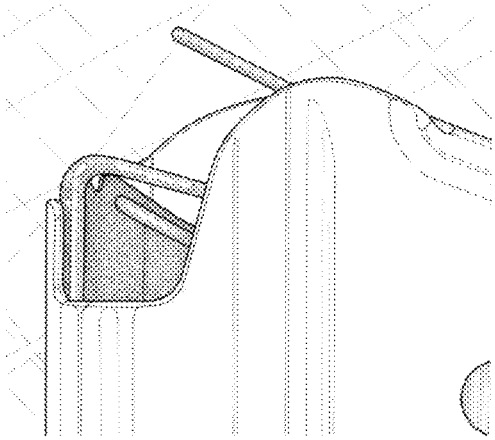

In the systems and methods herein, the spring, cylinder, detent, the left side slide release lever and the right side slide release lever of the ambidextrous slide release are composed of aluminum 6061, iron alloys, carbon steel, titanium, stainless steel, or other metallic parts; wherein the ambidextrous slide release is appended to the firearm. The firearm, which has the ambidextrous slide release appended thereto, has a slide locked the rear position (see FIG. 7), where: bigger notch shown is the section that allows the slide release/catch lever to have the room to travel up and lock the slide to the rear (see FIG. 8) and a lever has an indexing lug "111" that catches on a notch on the magazine (see FIG. 9).

Unless defined otherwise, all technical and scientific terms used herein have the same meaning as is commonly understood by one of ordinary skill in the art to which this invention (i.e., the ambidextrous slide release of the systems and methods herein) belongs. All patents, applications, published applications and other publications referred to herein are incorporated by reference in their entirety. If a definition set forth in this section is contrary to or otherwise inconsistent with a definition set forth in applications, published applications and other publications, that are herein incorporated by reference, the definition set forth in this document prevails over the definition that is incorporated herein by reference.

While various embodiments of the present invention have been described above, it should be understood that they have been presented by way of example only and not of limitation. Likewise, the various diagrams may depict an example architectural or other configuration for the invention, which is done to aid in understanding the features and functionality that can be included in the invention. The invention is not restricted to the illustrated example architectures or configurations, but the desired features can be implemented using a variety of alternative architectures and configurations. Indeed, it will be apparent to one of skill in the art how alternative functional, logical, or physical partitioning and configurations can be implemented to accomplish the desired features of the present invention. Also, a multitude of different constituent module names other than those depicted herein can be applied to the various partitions. Additionally, with regard to operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus, the breadth and scope of the present invention should not be limited by any of the above-described exemplary embodiments.

Terms and phrases used in this document and variations thereof, unless otherwise expressly stated, should be construed as open ended as opposed to limiting. As examples of the foregoing: the term "including" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the invention may be described or claimed in the singular, the plural is contemplated to be within the scope thereof unless limitation to the singular is explicitly stated. In addition, when a single callout line in the drawings leads to two or more separate reference numbers (first, second, etc. reference numbers), (and each reference numeral refers to a different piece of text in the detailed description) and it would be inconsistent to designate the drawing item being called out as both pieces of text, the drawing should be interpreted as illustrating two different variants. In one variant, the drawing item is referred to by the first reference number and in another variant, the drawing item is referred to by the second reference number, etc.

The presence of broadening words and phrases such as "one or more," "at least," "but not limited to," or other like phrases in some instances shall not be read to mean that the narrower case is intended or required in instances where such broadening phrases may be absent. The use of the term "module" does not imply that the components of functionality described or claimed as part of the module are all configured in a common package. Indeed, any or all of the various components of a module, whether CTRL logic or other components, can be combined in a single package or separately maintained and can further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

What is claimed is:

1. An ambidextrous slide release fitted on a firearm, wherein the ambidextrous slide release comprises:

a slide release and catch mechanism configured for locking a slide of the firearm to a rear position, followed by sending the slide forward on the firearm using a thumb, wherein the slide release and catch mechanism comprises:

a left side slide release lever;

a cylinder extending from the left side release lever, the cylinder having an internal cavity with a spring, a set screw on one end of the cylinder to hold in the spring and a dovetail flange on the opposite end of the cylinder, the dovetail flange further including a detent on the opposite end of the spring; and a right side slide release lever having a dovetail channel to accept the dovetail flange of the cylinder, and a cavity inside the channel for accepting the spring loaded detent of the cylinder.

2. The ambidextrous slide release fitted on the firearm of claim 1, wherein the detent operatively connects to a hole for the detent, thereby locking the right side slide release lever in place during use of the firearm.

3. The ambidextrous slide release fitted on the firearm of claim 1, wherein the dovetail flange is 45 degrees.

4. The ambidextrous slide release fitted on the firearm of claim 1, wherein the spring, the detent, and the set screw act as an end of the slide release.

5. The ambidextrous slide release fitted on the firearm of claim 1, wherein the dove tail flange operatively connects to the right side slide release lever and the set screw operatively connects to the left side slide release lever.

6. The ambidextrous slide release fitted on the firearm of claim 5, wherein the right side slide release lever operatively connects to a single piece, wherein the single piece is the cylinder and the left side slide release lever.

7. The ambidextrous slide release fitted on the firearm of claim 6, wherein the cylinder and the left side slide release lever make a perpendicular connection in the single piece.

8. The ambidextrous slide release fitted on the firearm of claim 6, wherein the cylinder and the right side slide release lever make a perpendicular connection with each other.

9. The ambidextrous slide release fitted on the firearm of claim 6, wherein the right side slide release lever is parallel to the left side slide release lever.

10. The ambidextrous slide release fitted on the firearm of claim 5, wherein the spring, cylinder, detent, and the right side slide release lever are composed of a material selected from the group consisting of: aluminum 6061, iron alloys, carbon steel, titanium, stainless steel, or other metallic parts.

11. The ambidextrous slide release fitted on the firearm of claim 1, wherein the dovetail flange comprises a sawtooth pattern.

12. The ambidextrous slide release fitted on the firearm of claim 1, wherein the left slide release lever further comprises a lug.

13. The ambidextrous slide release fitted on the firearm of claim 1, wherein the right slide release lever comprises a 20 degree channel configured for receiving a 20-degree appendage.

14. The ambidextrous slide release fitted on the firearm of claim 5, wherein the cylinder comprises a 20 degree appendage configured for fitting into a 20-degree channel.

15. The ambidextrous slide release fitted on the firearm of claim 1, wherein the firearm is selected from the group consisting of: a 1911 slide release, a 2011 slide release, a 1911 slide catch, and a 2011 slide catch.

* * * * *